US007025013B1

(12) United States Patent
Staerzl et al.

(10) Patent No.: US 7,025,013 B1
(45) Date of Patent: Apr. 11, 2006

(54) MULTILAYERED SUBMERSIBLE STRUCTURE WITH FOULING INHIBITING CHARACTERISTIC

(75) Inventors: Richard E. Staerzl, Fond du Lac, WI (US); Christopher J. Misorski, Fond du Lac, WI (US); Mitesh B. Sheth, Fond du Lac, WI (US); Kevin R. Anderson, Fond du Lac, WI (US); Corey N. Nianekeo, Marsyville, WA (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/893,512

(22) Filed: Jul. 16, 2004

(51) Int. Cl.
*B63B 59/00* (2006.01)

(52) U.S. Cl. ..... 114/222

(58) Field of Classification Search ..... 114/67 R, 114/67 A, 222
See application file for complete search history.

(56) References Cited

U.S. PATENT DOCUMENTS

| | | | | |
|---|---|---|---|---|
| 948,355 | A | 2/1910 | Tatro et al. | |
| 1,021,734 | A | 3/1912 | Delius et al. | |
| 3,069,336 | A | 12/1962 | Waite et al. | |
| 3,109,763 | A | 11/1963 | Finger | |
| 3,625,852 | A | 12/1971 | Anderson | 204/196 |
| 3,849,226 | A | 11/1974 | Butz | 156/247 |
| 4,722,860 | A * | 2/1988 | Doljack et al. | 442/111 |
| 5,052,962 | A | 10/1991 | Clark | 440/83 |
| 5,126,172 | A | 6/1992 | Dore, III | 427/421 |
| 5,601,049 | A | 2/1997 | Hordis et al. | 114/357 |
| 6,086,813 | A | 7/2000 | Gruenwald | 264/460 |
| 6,173,669 | B1 | 1/2001 | Staerzl | 114/222 |
| 6,209,472 | B1 | 4/2001 | Staerzl | 114/222 |
| 6,314,906 | B1 | 11/2001 | Tesfaye | 114/357 |
| 6,476,159 | B1 | 11/2002 | Ishino | 525/474 |
| 6,514,401 | B1 | 2/2003 | Chyou et al. | 205/739 |
| 6,547,952 | B1 * | 4/2003 | Staerzl | 205/724 |

* cited by examiner

*Primary Examiner*—Stephen Avila
(74) *Attorney, Agent, or Firm*—William D. Lanyi

(57) ABSTRACT

A multilayered submersible structure has an outer coating that is disposed in contact with water in which the structure is submerged, a current distribution layer or charge distribution layer, an electrical conductor connectable in electrical communication to a source of electrical power, and a support structure. By selectively energizing the current distribution layer, or charge distribution layer, chemical and ionic changes can be caused in the water immediately adjacent the outer coating or layer to inhibit the growth of marine organisms on the outer surface of the submersible structure.

33 Claims, 7 Drawing Sheets

MULTILAYERED SUBMERSIBLE STRUCTURE WITH FOULING INHIBITING CHARACTERISTIC

BACKGROUND OF THE INVENTION

1. Field of the Invention

The present invention is generally related to a submersible structure and, more particularly, to a submersible structure that can be used to cause a change in the water adjacent to an exposed surface of the submersible structure which has the beneficial effect of inhibiting fouling by marine organisms, such as barnacles and algae.

2. Description of the Prior Art

Various submersible objects, such as boat hulls, are manufactured according to techniques that are generally known to those skilled in the art. These boat hulls can be made of metal or a polymer composite structure. Several techniques are known to those skilled in the art which are advantageous in manufacturing boat hulls that are made of reinforced polymer material, such as fiberglass.

U.S. Pat. No. 3,109,763, which issued to Finger on Nov. 5, 1963, describes a method and apparatus for forming a fiber reinforced resin panel. Certain aspects of this invention relate to a method for producing reinforced synthetic resin panels having improved weather and erosion resistance, a colored coating combined with a different colored core which are intermixed at the interface to produce a decorative finish, and a reinforced synthetic resin panel having a weather resistant coating of controlled crinkle contour applied to a surface thereof.

U.S. Pat. No. 3,849,226, which issued to Butz on Nov. 19, 1974, describes a method for producing fiber reinforced resin panels with gelcoat fiber layer and lacquer protective coating. This invention relates to a method of producing fiber reinforced resin panels with a gelcoat type protective cover layer where the freshly impregnated fiber layer covered by film is first heated until the resin gels, whereupon the cover film is peeled off and a protective layer of similar resin or of unrelated lacquer is applied to the gelled resin impregnated fiber layer and the laminate is cured to harden.

U.S. Pat. No. 5,126,172, which issued to Dore, III on Jun. 30, 1992, describes a plastic sheet for a boat hull and the like and a method for making it. A fiber reinforced plastic laminate is composed of synthetic resin material, which contains spheres, and short strands of chopped fibers mixed into the resin/sphere blend in criss-cross, hodge-podge fashion, the sphere members and high application pressure combining to force down any upstanding chopped fibers and to make the chopped fibers lies flat in the resin layer and to knock air out of the resin layer, the sphere members comprising a plurality of high density spheres.

U.S. Pat. No. 5,601,049, which issued to Hordis et al. on Feb. 11, 1997, describes a boat hull. A method of protecting a plastic boat hull against blistering comprises the steps of applying an outer gelcoat layer to the inner surface of a mold, applying a layer of barrier coat material of microspheres thoroughly mixed in a synthetic resin matrix to the outer gelcoat layer to form a barrier coat layer, bonding the barrier coat layer to the outer gelcoat layer, applying an outer layer of fiber reinforced synthetic plastic to the barrier coat layer, bonding the outer fiber reinforced synthetic plastic layer to the barrier coat layer, applying successive layers of fiber reinforced synthetic plastic to form a laminated boat hull having a series of fiber reinforced synthetic plastic layers with an inner layer, and applying an inner gelcoat layer to the inner layer of the fiber reinforced synthetic plastic layers.

U.S. Pat. No. 6,086,813, which issued to Gruenwald on Jul. 11, 2000, discloses a method for making self-supporting thermoplastic structures. A technique for forming self-supporting structures with thermoplastic material incorporates a plasma heated spray of thermoplastic material with glass fiber reinforcement, such as glass fibers. The material is sprayed into a mold which is shaped to create the desired form and configuration of the self-supporting structure. A mixture of thermoplastic powder and reinforcing fibers is carried by a stream of inert gas through a plasma region. A thermoplastic material is melted as it passes through the plasma region and the resulting melted polymer is sprayed against the surface of a form mold.

U.S. Pat. No. 6,173,669, which issued to Staerzl on Jan. 16, 2001, discloses an apparatus and method for inhibiting fouling of an underwater surface. A marine fouling prevention system comprises two conductive surfaces and a device that alternates the direction of electric current between the two surfaces. The current is caused to flow through seawater in which the two surfaces are submerged or partially submerged. A monitor measures the current flowing from one of the two conduction surfaces and compares it to the current flowing into the other conduction surface to assure that no leakage of current of substantial quantity exists.

U.S. Pat. No. 6,209,472, which issued to Staerzl on Apr. 3, 2001, discloses an apparatus and method for inhibiting fouling of an underwater surface. A system for inhibiting marine organism growth on underwater surfaces provides an electric current generator which causes an electric current to flow proximate the underwater surface. A source of power, such as a battery, provides electrical power to the electric current generator.

U.S. Pat. No. 6,314,906, which issued Tesfaye on Nov. 13, 2001, describes a boat structure including iridescent particles. A multilayered fiberglass boat structure is described. The fiberglass boat structure includes a plurality of layers of resin impregnated fiberglass reinforcement and a plurality of layers of a polyester film. Each film layer is formed from a gelcoat, with at least one of the film layers formed from a gelcoat that includes iridescent polyester particles.

U.S. Pat. No. 6,547,952, which issued to Staerzl on Apr. 15, 2003, discloses a system for inhibiting fouling of an underwater surface. An electrically conductive surface is combined with a protective surface of glass in order to provide an anode from which electrons can be transferred to seawater for the purpose of generating gaseous chlorine on the surface to be protected. Ambient temperature cure glass (ATC glass) provides a covalent bond on an electrically conductive surface, such as nickel-bearing paint. In this way, boat hulls, submerged portions of outboard motors, and submerged portions of sterndrive systems can be protected effectively from the growth of marine organisms, such as barnacles. The electrically conductive surface generates electrons into the seawater in order to create chlorine gas at the surface which inhibits and discourages marine growth.

U.S. Pat. No. 6,476,159, which issued to Ishino on Nov. 5, 2002 discloses a gelcoat composition. A gelcoat composition composed of a base resin having double bonds in a molecule and a modified silicone oil having double bonds in a molecule is described. The gelcoat composition is inexpensive and yet highly stainproof. It is suitable for application to bathroom waterproof panels, etc.

U.S. Pat. No. 3,625,852, which issued to Anderson on Dec. 7, 1971, describes a marine anti-fouling system. The system is intended for use with boat and ship hulls having a keel and sides diverging upwardly therefrom. The anti-fouling system comprises a pair of laterally spaced elongated anode electrode components each mounted externally on one side of the hull substantially adjacent the keel and lengthwise thereof. It also comprises an elongated cathode electrode component mounted externally on and lengthwise of the keel in spaced relationship between the anode electrode components. The system further comprises a source of electrical current and electrical circuit means therefor for energizing the anode electrode components with a positive potential and the cathode electrode components with a negative potential with the cathode electrode component being electrolytically common to the anode electrode components.

U.S. Pat. No. 5,052,962, which issued to Clark on Oct. 1, 1991, describes a naval electrochemical corrosion reducing. The corrosion reducer is used with ships having a hull, a propeller mounted on a propeller shaft and extending through the hull, therein supporting the shaft, at least one thrust bearing and one seal. Improvement includes a current collector and a current reduction assembly for reducing the voltage between the hull and shaft in order to reduce corrosion due to electrolytic action. The current reduction assembly includes an electrical contact, the current collector, and the hull. The current reduction assembly further includes a device for sensing and measuring the voltage between the hull and the shaft and a device for applying a reverse voltage between the hull and the shaft so that the resulting voltage differential is from 0 to 0.05 volts. The current reduction assembly further includes a differential amplifier having a voltage differential between the hull and the shaft. The current reduction assembly further includes an amplifier and the power output circuit receiving signals from the differential amplifier and being supplied by at least one current supply. The current selector includes a brush assembly in contact with a slip ring over the shaft so that its potential may be applied to the differential amplifier.

U.S. Pat. No. 3,069,336, which issued to Waite et al on Dec. 18, 1962, discloses a means for protecting ships' hulls. The system relates to ships and in particular to the protection of metal hulls against corrosion, but it further relates to the protection of ships' hulls against fouling with barnacles or other similar marine growth and marine vegetation.

U.S. Pat. No. 1,021,734, which issued to Delius et al on Mar. 26, 1912, describes a process for protecting ships from barnacles. The invention relates to sea going vessels which have hulls which are either made of metal or sheathed with metal and is intended for protection of vessels from the accumulation of barnacles. This is accomplished by providing a means for electrically destroying the barnacles that may be attached to the ship.

U.S. Pat. No. 948,355, which issued to Tatro et al on Feb. 8, 1910, describes an expeditious and inexpensive means for removing pests from ship's bottoms and for protecting from such pests any non-metallic objects located or moving under seawater. The system uses the anode and the cathode of an electric battery and the two poles of the battery must both be in contact with the seawater so that the circuit of the electric current must be completed through the water.

The patents described above are hereby expressly incorporated by reference in the description of the present invention.

SUMMARY OF THE INVENTION

A multilayered submersible structure, made in accordance with a preferred embodiment of the present invention, comprises a support structure, an electrical conductor connectable in electrical communication to a source of electrical power, a current distribution layer connected in electrical communication with the electrical conductor and attached to the support structure, and an outer coating disposed in contact with the current distribution layer.

BRIEF DESCRIPTION OF THE DRAWINGS

Several embodiments of the present invention will be more fully and clearly understood from a reading of the description of the preferred embodiment in conjunction with the drawings, in which.

DESCRIPTION OF THE PREFERRED EMBODIMENT

Figure 1:
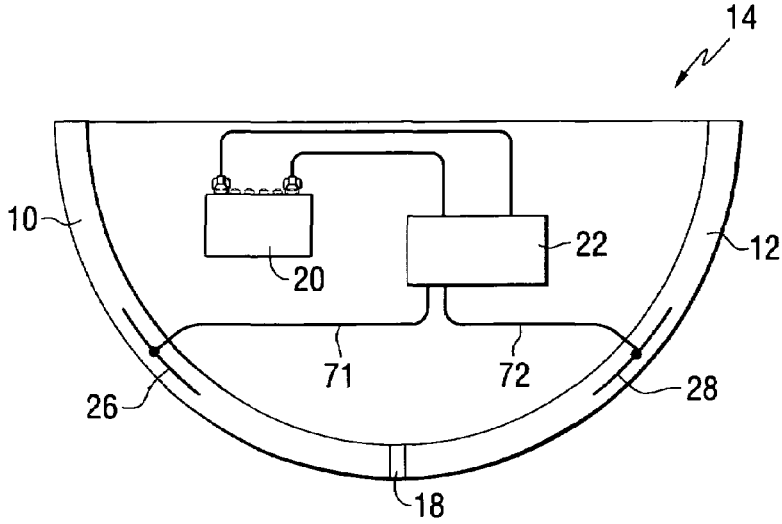
FIG. 1 is a section view of a marine vessel showing its port and starboard side of the hull.

Throughout the description of the preferred embodiment of the present invention, like components will be identified by like reference numerals.

The use of electrical conductive surfaces, which are electrically insulated from each other, for the purpose of creating a chemical or ionic change in the water immediately adjacent to submerged surfaces is described in detail in U.S. Pat. Nos. 6,173,669 and 6,209,472, described above. The use of a conductive surface coated by a room temperature glass is described in detail in U.S. Pat. No. 6,547,952. It has been known since at least the early part of the $20^{th}$ century that the production of chlorine gas bubbles on the surface of a marine vessel or other submerged structure has the beneficial effect of discouraging the growth of marine organisms on that submerged surface. In addition, it has been known for many years that marine vessels can be efficiently manufactured from various polymer materials, such as fiber glass and gelcoat, to efficiently manufacture pleasure craft of many different types. A problem that must be overcome in systems of this type is the degradation or decomposition of the electrically conductive surface or layer which is used to cause the chemical or ionic change in the water adjacent to the submerged surface being protected. The inherent electrochemical operation of devices of this type can cause the electrically conductive surface to be changed as a normal result of the electrochemical processes used to discourage organism growth.

Many types of biocides are well known for the purpose of protecting the exposed surfaces of a marine vessel hull from marine organism growth. Most of these biocides are applied as paint and progressively emit chemicals into surrounding water that can be harmful to the environment and must be periodically replaced on the hull surface. The inherent disadvantage of biocides is the natural emission of chemicals into surrounding water. Although these biocides can be effective in limiting or inhibiting marine organism growth, the chemical emissions are a natural byproduct of their use.

A significant advantage can therefore be achieved if a boat hull could be manufactured in such a way that it avoids emission of poison into the environment. The systems described in U.S. Pat. Nos. 6,173,669 and 6,209,472 provide systems of this general type which do not require the painting of boat hulls with biocide materials. It would be further beneficial if a submersible surface could be provided which possesses the advantageous characteristics described in these patents while facilitating the efficient manufacture of such a boat hull in a way which serves the basic purpose of changing the chemical or ionic character of the water immediately adjacent to the hull surface while also creating a long lasting and durable boat hull or other submersible surface that can be readily manufactured.

FIG. 1 is a simplified representation of a preferred embodiment of the present invention which is applied to a boat hull structure. The structure, which will be described in greater detail below, comprises a port side 10 and a starboard side 12 of a marine vessel 14 which is shown as a section view. The port and starboard sides, 10 and 12, are electrically conductive and insulated from each other by an insulative portion 18 which is shown in FIG. 1 at the keel of the marine vessel 14. A source of electrical power, which can comprise a battery 20 and a controller 22, is connected in electrical communication with the port and starboard sides, 10 and 12, of the boat. Two conductors, 26 and 28, are associated with the port and starboard sides, 10 and 12, to facilitate the electrical connection between conductive portions of those surfaces and the source of electrical power. Two wires, 71 and 72, allow the conductors, 26 and 28, to be connected in electrical communication with the source of electric power.

A particularly preferred embodiment of the present invention comprises four functional elements. An electric current distribution layer is provided. Its primary function is to distribute an electrical charge over the surface that is intended to be protected from marine fouling, such as from the growth of organisms. An outer coating is provided between the current distribution layer and the water in which the marine vessel or other submersible structure is submerged. A function of the outer coating in a preferred embodiment of the present invention is to protect the electric current distribution layer from degradation or decomposition through use. Its primary function in a preferred embodiment of the present invention is to assist in the conduction of electric current from the electric current distribution layer, or charge distribution layer, to the water surrounding the structure. An electrical conductor, such as those identified by reference numerals 26 and 28 in FIG. 1 is provided. Its primary function is to facilitate the electrical connection between the current distribution layer and a source of electrical power. A support structure is provided. Its primary function in a preferred embodiment of the present invention is to support the other elements of a preferred embodiment of the present invention in the form of a marine vessel or other submersible structure.

FIGS. 2–6 show sequential steps for manufacturing a marine vessel, such as the marine vessel 14 shown in FIG. 1, according to a particularly preferred embodiment of the present invention. A mold 30 is provided to define the shape of the outermost surface of the boat hull. During an initial manufacturing step, masking devices 32, such as removable tape, are placed at strategic locations along the inner surface of the mold 30. Subsequent to the masking procedure, an outer layer 40 of an electrically conductive polyester or vinyl ester gelcoat is sprayed onto the inner surface 34 of the mold 30.

In known fabrication techniques, the gelcoat application process typically comprises the application of a nonconductive cosmetic gelcoat in three passes, with each pass being approximately 0.006 to 0.007 inches thick. These three layers, when cured, form a gelcoat layer that is approximately 0.018 to 0.020 inches thick. The polyester gelcoat layer is curable with a methyl ethyl ketone peroxide catalyst (MEKP catalyst). The gelcoat application process is typically followed with a vinylester skincoat that is a combination of chopped glass and vinylester resin. The skincoat is typically approximately 0.090 inches thick and is applied in a one step process.

In a preferred embodiment of the present invention, the gelcoat and skincoat are formed from a relatively inert electrically conductive material that comprises electrically conductive powder, such as carbon or graphite, particles or fibers suspended in a vinylester resin. This forms an outer layer 40 of a conductive material. The outer layer 40, according to a preferred embodiment of the present invention, is electrically conductive through its thickness. In other words, it is not absolutely necessary that the outer layer conduct the electrical current efficiently along its length or width of the boat surface, but it is important that electron current can pass through the thickness of the outer layer 40. In a particularly preferred embodiment of the present invention, the outer layer, or gelcoat layer, has a resistance of approximately 2,000 ohms through a thickness of approximately 0.005 inches when the outer layer is dry. However, when the outer layer is submerged and is wetted, this resistance decreases to approximately 100 ohms. In a preferred embodiment of the present invention, the outer layer performs two functions. These include the protection of inner layers and the conduction of an electron current through the thickness of the outer layer.

In most manufacturing procedures known to those skilled in the art, the gelcoat layer and skincoat layer are followed by a bulk lamination layer during which multiple layers of chopped glass and woven roving are applied alternately, as laminae, to create a composite support structure. The chopped glass layers are approximately 0.030 inches thick and the woven roving typically is a 24 ounce fiber glass cloth. Each combination of the chopped glass and woven roving are referred to as a "bottom." The overall length of the boat hull will determine how many such bottoms are required. Polyester resins are typically used to form the bulk lamination.

In a particularly preferred embodiment of the present invention, the fiberglass laminae are not placed directly on the gelcoat and skincoat layers. Instead, a current distribution layer or charge distribution layer is applied before the fiberglass support structure.

Figure 2:
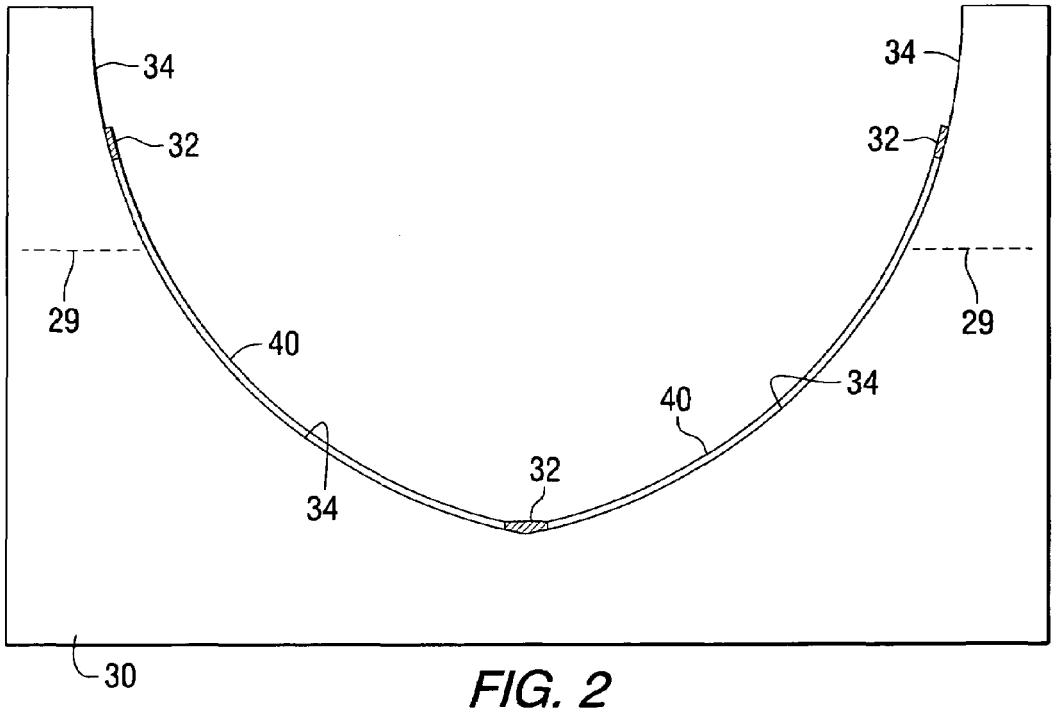
FIGS. 2–6 show sequential steps in manufacturing a particularly preferred embodiment of the present invention.
Figure 3:
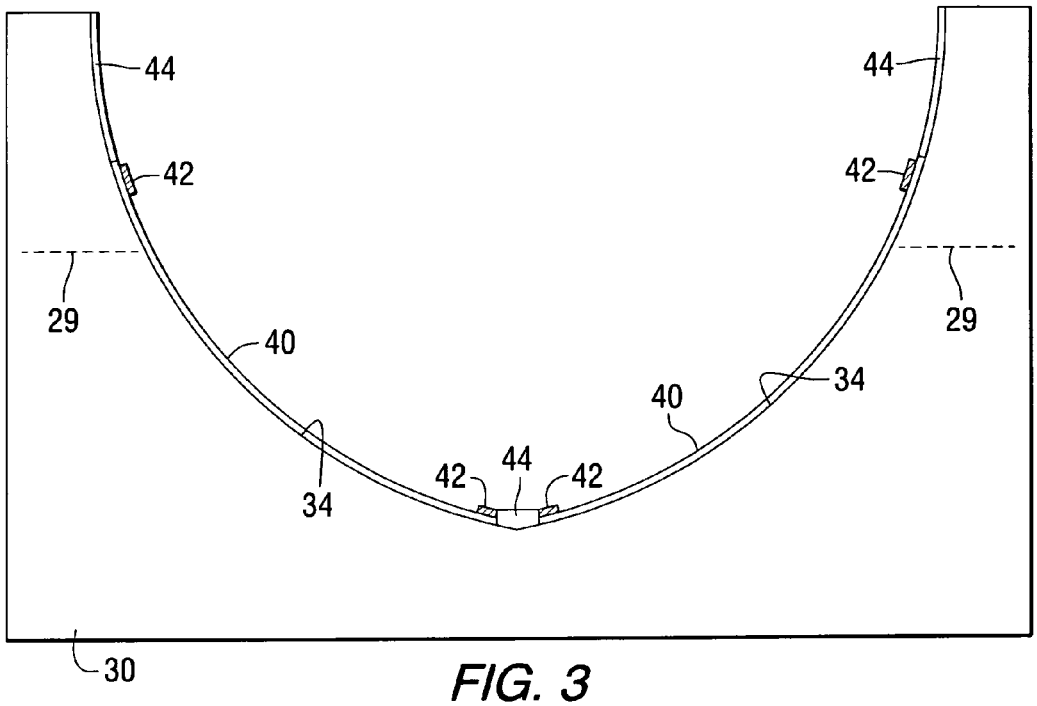

With continued reference to FIG. 2, the electrically conductive outer layer 40 is shown applied on the surface 34 portions of the mold 30 which is not masked by the masking devices 32. After the electrically conductive gelcoat material, or outer layer 40, is applied as shown in FIG. 2, certain portions of the electrically conductive gelcoat material 40 are masked by masking devices 42 and a standard nonconductive gelcoat material 44 can be applied where shown in FIG. 3. The gelcoat material identified by reference numeral 44 is intended to act as an electrical insulator. At the keel, the electrically insulative gelcoat material 44 prevents electrical communication directly between the port and starboard sides of the electrically conductive gelcoat outer layer 40. Metal through-hull fittings must also be electrically isolated from the conductive layer to prevent corrosion of such fittings. The upper regions of the electrically insulative gelcoat 44 on the port and starboard sides are intended to reduce the cost of the hull structure because the normal, or electrically insulative, gelcoat 44 is less expensive than the electrically conductive gelcoat 40. The electrically conductive gelcoat 40 comprises electrically conductive powder, particles or fibers, such as carbon, which are suspended in a polymer matrix, such as polyester resin, vinyl ester resin, or polyurethane. In a preferred embodiment of the present invention, the outer layer 40 is also colored to provide an aesthetic appearance on the outer surface of the boat hull.

Figure 4:
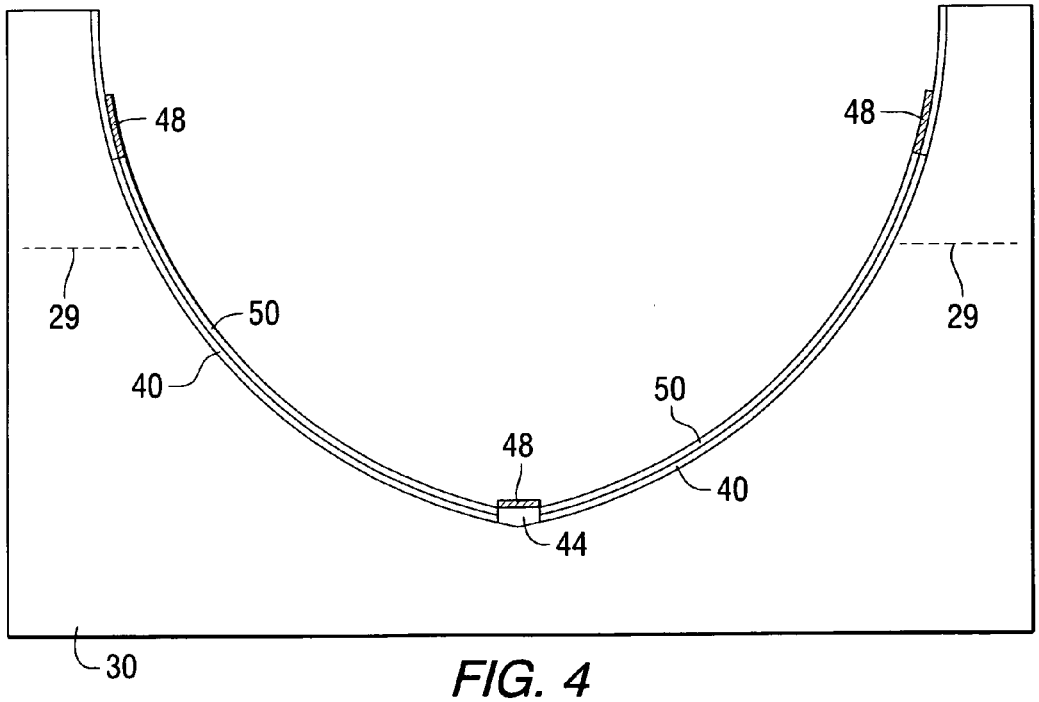

In FIG. 4, the masking devices 42 have been removed and an initial portion 50 of the current distribution layer is sprayed onto the gelcoat outer layer 40. The current distribution layer, or charge distribution layer, in a preferred embodiment of the present invention comprises a polyester resin or other polymer material with embedded electrically conductive particles or fibers, such as carbon fibers. This material can be sprayed onto the inner surface of the gelcoat outer layer 40 and rolled into place to make sure that it covers the entire region which is intended to be protected from fouling by marine organisms. The primary function of the current distribution layer in a preferred embodiment of the present invention is to assure that an electron current will flow outwardly from the current distribution layer 50 and through the conductive gelcoat outer layer 40 when a voltage potential is applied between the starboard and port sides of the marine vessel. The electrical conductivity of the current distribution layer 50 is sufficiently high to cause the entire charge distribution layer on one side of the marine vessel to be at essentially an identical voltage potential relative to the other side of the vessel.

Figure 5:
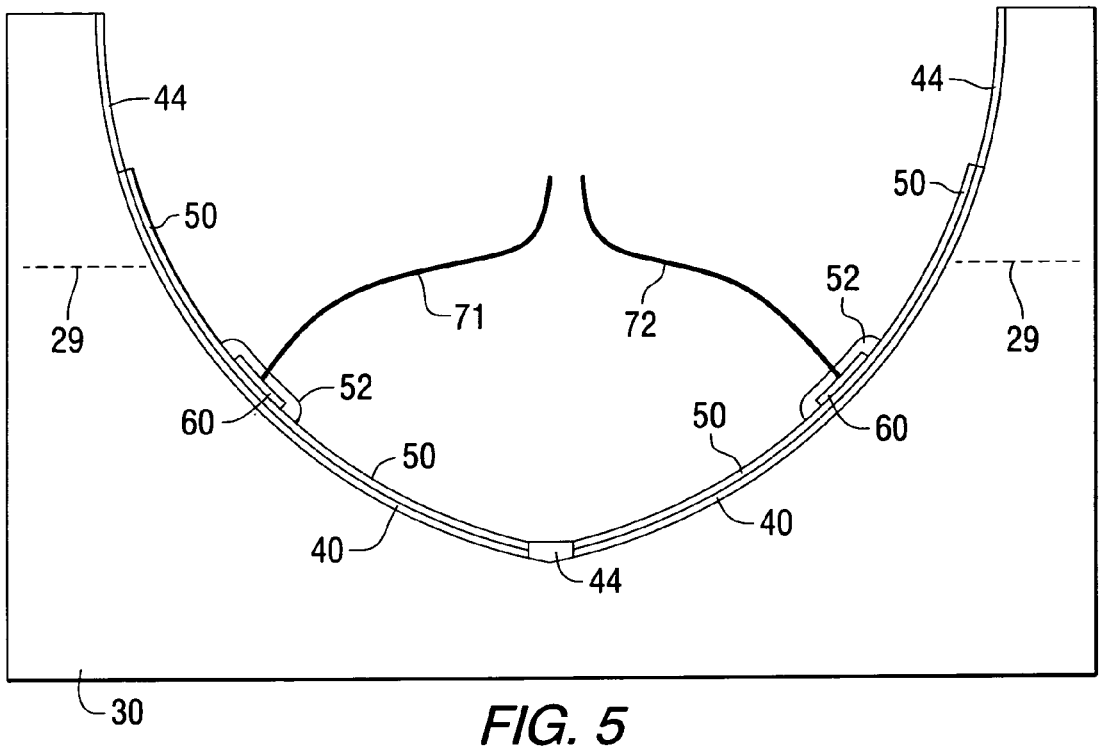

FIG. 5 shows the structure of FIG. 4 after an electrical conductor 60 is placed in electrical and physical contact with the initial portion 50 of the current distribution layer. After the electrical conductor 60 is placed as shown in FIG. 5, additional material 52 of the current distribution layer is added to make sure that the electrical conductor 60 is adequately bonded to the charge distribution layer, or current distribution layer, and that the conductor 60 is securely attached in electrical communication with the current distribution layer 50. In other words, the layers identified by reference numerals 50 and 52 in FIG. 5 encapsulate the electrical conductor 60 in intimate physical and electrical contact with the current distribution layer and physically bonded to that layer. Two wires, 71 and 72, represent electrical connections to the two conductors 60. However, in a particularly preferred embodiment of the present invention, more than two wires may be used as will be described in greater detail below. The purpose of the wires, 71 and 72, is to facilitate an electrical connection between a source of electrical power and the current distribution layer 50 through the electrical conductor 60.

Figure 6:
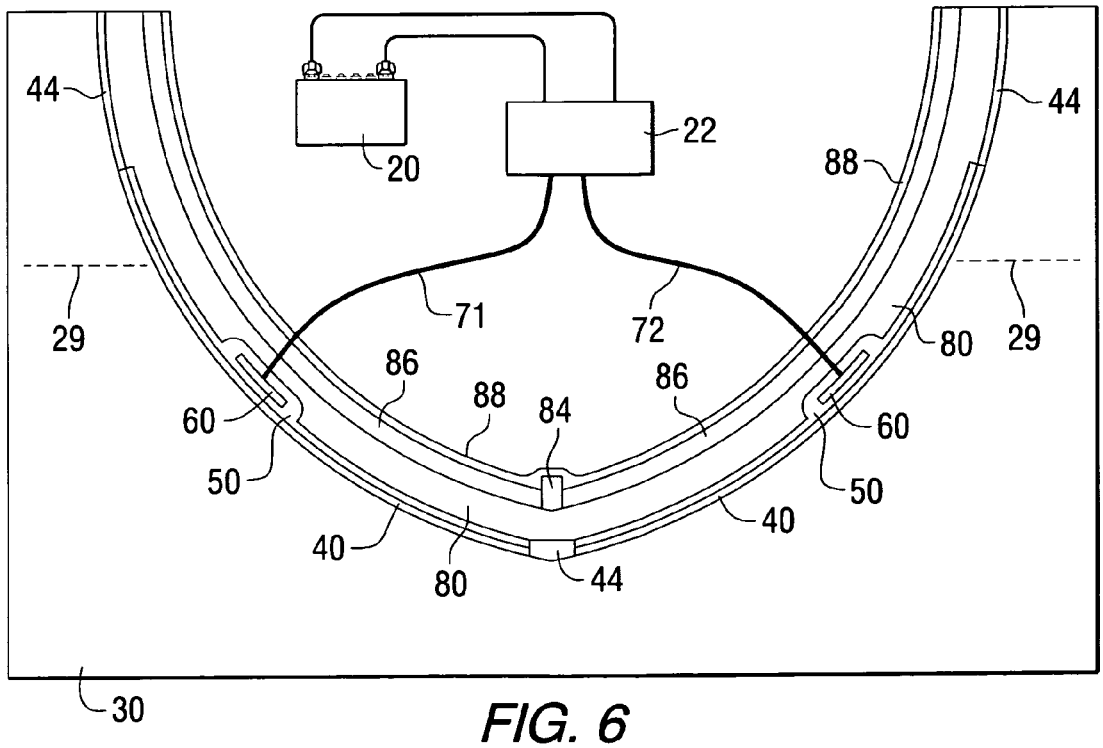

FIG. 6 shows a step that is performed subsequent to the step described above in conjunction with FIG. 5. Over the current distribution layer 50, a support structure is provided which typically comprises multiple layers of fiberglass and fiberglass cloth, or woven roving. It is intended that this fiberglass support structure be generally nonconductive. If the non-conductivity of the support structure cannot be assured, an insulative layer would be placed over the current distribution layer 50 and under the support structure 80. If the support structure 80 is generally electrically non-conductive, it can be placed immediately over the current distribution layer 50. As described above, the application of the bulk lamination, or support structure 80, typically comprises multiple layers of chopped glass which is approximately 0.030 inches thick with 24 ounce woven glass roving, or fiberglass cloth. Several such alternating laminae are provided, with the number of laminations being determined by the overall length of the boat. Polyester resins with chopped glass suspended therein are typically used in creating the bulk lamination.

With continued reference to FIG. 6, reference numeral 84 represents a wooden structural member used to provide additional support to the marine vessel hull. Reference numeral 86 identifies a plurality of wooden ribs which extend to the port and starboard sides of the vessel from the wooden member 84 at its keel. An additional layer of woven roving, or fiberglass cloth, is identified by reference numeral 88 and is placed over the wooden structure comprising structural members 84 and 86.

With the wires, 71 and 72, connected in electrical communication with the electrical conductor 60, these wires can be connected to the source of electrical power as shown in FIG. 6 to allow the port and starboard current distribution layers to be independently energized as either an anode or a cathode. As described above, a preferred embodiment of the present invention alternates the connections between the port and starboard current distribution layers and the source of electrical power so that they alternately switch from being connected as a cathode and as an anode so that both sides of the marine vessel can be protected through the sequential production of chlorine gas or other chemical or ionic change at the water surface that is in contact with the outer layer 40 when the boat is in use.

In FIGS. 2–6, dashed line 29 represents the position where the surface of a body of water is expected to exist when the boat is floating in a body of water. The conductive gelcoat 40 and the current distribution layer 50 are shown extended above dashed line 29 so that all wetted surfaces of the marine vessel hull can be protected from fouling by marine organisms.

Figure 7:
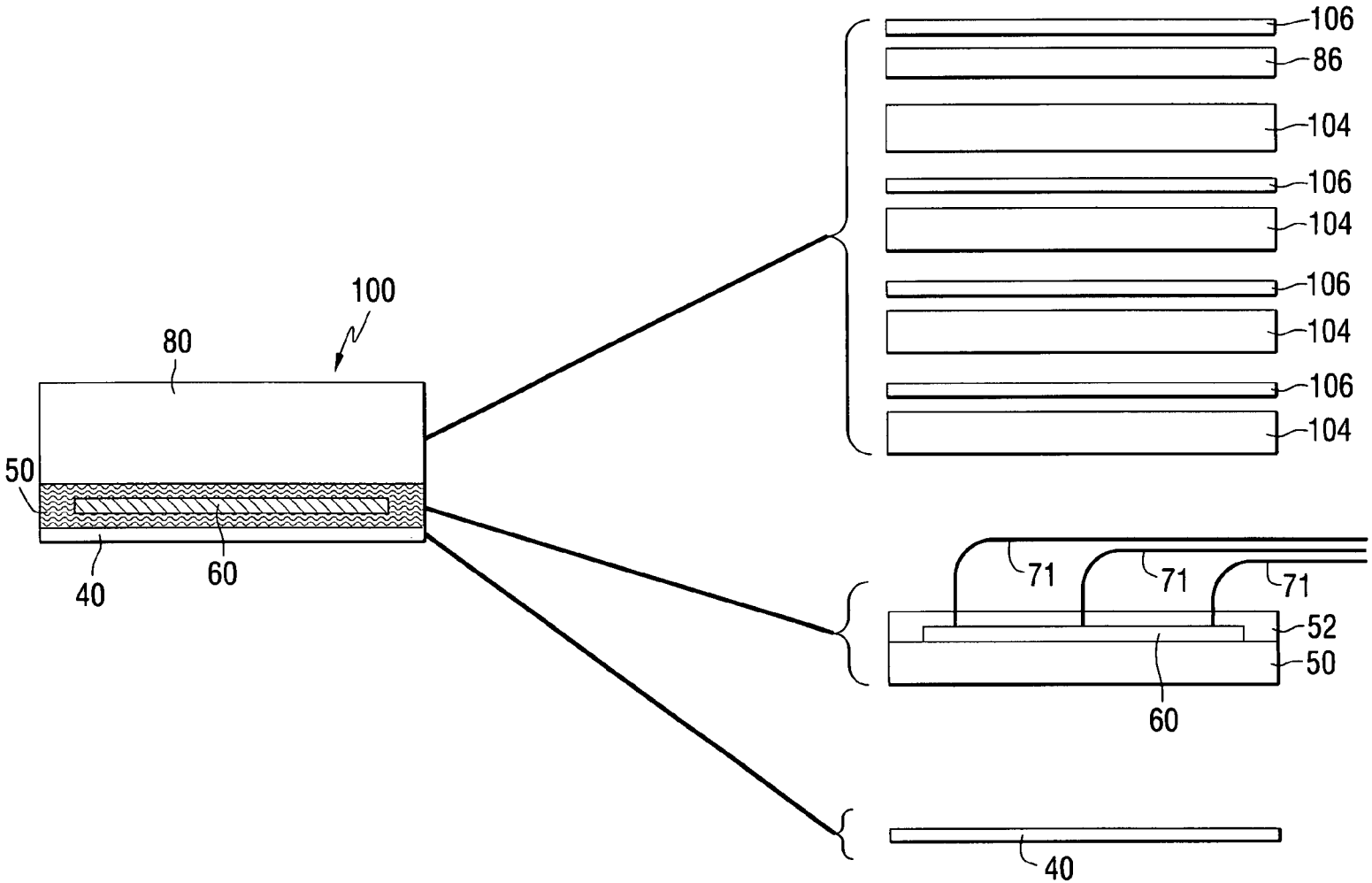
FIG. 7 shows a section view of a hull structure with an exploded portion showing individuals layers.

FIG. 7 shows a section of a boat hull, or other submersible structure, with the layers used in a particularly preferred embodiment of the present invention. As described above, these layers are the outer layer 40, the current distribution layer 50, the electrical conductor 60 and the support structure 80. The right side of FIG. 7 shows exploded versions of these layers to allow more specific description thereof.

The outer layer 40 comprises relatively inert electrically conductive particles, powder or fibers suspended in a polymer material, such as a polyester resin. This material is an electrically conductive gelcoat material. It can comprise a gelcoat and a skincoat layer as discussed above.

The current distribution layer 50 is applied in two steps, which create portions 50 and 52, so that the electrical conductor 60 can be encapsulated within the structure of the electrically conductive current distribution layer 50. Wires 71 are shown connected to the electrical conductor 60 so that current can be conducted to and from the electrical conductor 60. Depending on whether the current distribution layer 50 is used as an anode or cathode will be determined by the operation of the source of electrical power and the sequencing of the procedures relating to the antifouling system shown in FIG. 1. It should be understood that the electrical conductor 60 is functionally identical to the electrical conductors, 26 and 28, described above in conjunction with FIG. 1.

The multiple laminae of the support structure 80 are shown at the right side of FIG. 7. The support structure comprises a plurality of alternating layers of chopped glass in a polyester resin matrix, identified by reference numeral 104, and 24 ounce woven roving, or fiberglass cloth 106. A wooden member 86 is shown directly under the final layer of woven roving 106.

In FIGS. 1–7, a particularly preferred embodiment of the present invention is illustrated. It should be understood, however, that several alternative embodiments of the present invention can perform the overall functions adequately and, in certain specific applications, may be preferred. These alternative embodiments will be described below.

Figure 8:
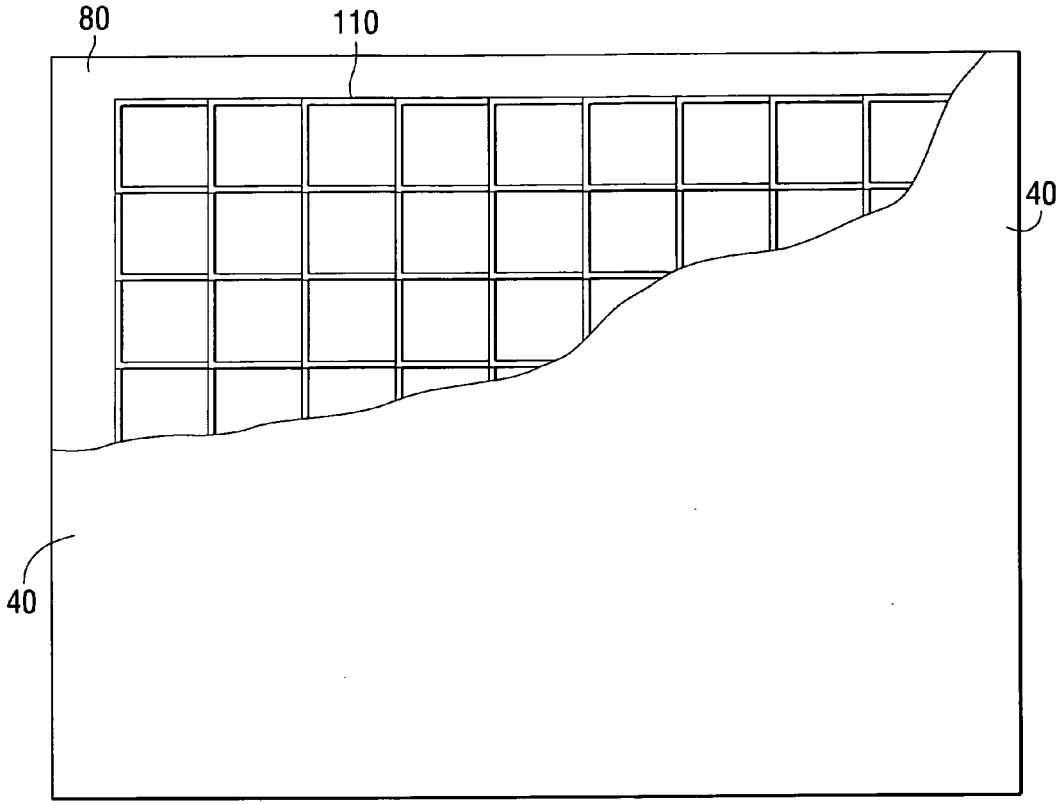
FIG. 8 shows an alternative embodiment of a current distribution layer.

FIG. 8 shows an alternative embodiment of the present invention in which the polymer matrix with electrically conductive particles or fibers, identified by reference numeral 50 above, is replaced by a metal screen 110. The metal screen 110 is illustrated in FIG. 8 located between the support structure 80, which is typically a plurality of laminae of fiberglass and fiberglass cloth, and the outer layer 40, which is typically an electrically conductive gelcoat material. The metal screen 110 can be a simple wire structure, such as chicken wire or a similar material. In one alternative embodiment of the present invention, the wire screen 110 is selected to have relatively small openings, such as 0.5 inches on a side or less. Although various sizes of metal screen can be used in this embodiment shown in FIG. 8, the smaller sized openings will tend to facilitate the production of chlorine on the outer surface of the conductive gelcoat 40 without significant regions where chlorine is not being produced on the outer surface of the boat hull. The wire screen 110 shown in FIG. 8 can be replaced with a wire mesh which comprises small metal fibers of the size generally used in scouring pads or the like. This metal mesh is saturated in resin and applied with rollers to assure that it conforms to the shape of the boat hull and covers the essential areas where the chlorine production is desired. A pressed mat of carbon fibers can be used for this purpose. A woven carbon cloth is also suitable as the current distribution layer. Alternatively, another embodiment of the present invention could utilize a metal foil with a plurality of holes formed therethrough to assure proper bonding between the conductor 60 and the conductive gelcoat 40.

Figure 9:
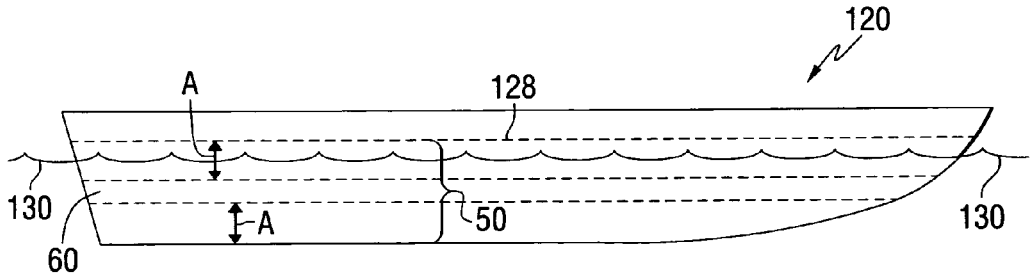
FIG. 9 is a side view of a marine vessel showing the physical locations of certain portions of a preferred embodiment of the present invention.

FIG. 9 is a side view of a boat 120 partially submerged in a body of water. Reference numeral 50 identifies the approximate height of the current distribution layer which is located under an outer layer 40 of conductive gelcoat described above. Reference numeral 60 identifies the strip of electrical conductor that extends along the length of the boat 120 to allow adequate electrical connection between a source of electrical power and the current distribution layer 50. It can be seen, as represented by dashed line 128, that the upper edge of the current distribution layer 50 is located above the water line 130 to assure that adequate coverage is available to prevent or inhibit the growth of marine organisms on the outer surface of the hull of the boat 120. The conductor 60 is located approximately at the center of the height of the current distribution layer 50, as represented by arrows A which are generally equal in length to each other.

With continued reference to FIGS. 1–9, it should be understood that the electrical conductor 60 is selected from a material that is a very good electrical conductor. This material can be copper or any other good electrical conductor which allows the wires, 71 and 72, to be connected to the current distribution layer 50 to assure good conductivity between the source of electrical power and the current distribution layer 50. It should also be understood that in certain embodiments of the present invention, the electrical conductor 60 can be merely one or more electrical wires connected between the source of electrical power and the current distribution layer 50.

Figure 10:
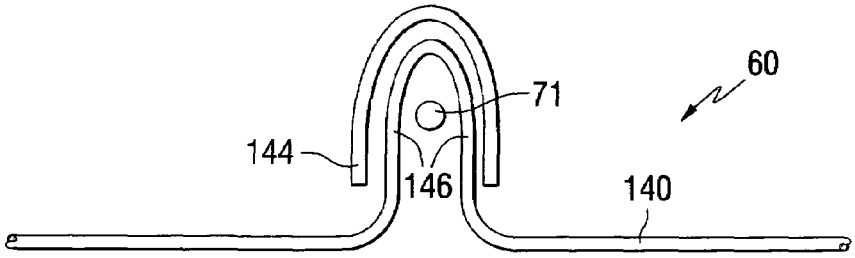
FIGS. 10–12 show how the electrical conductor can be connected to wires.
Figure 11:
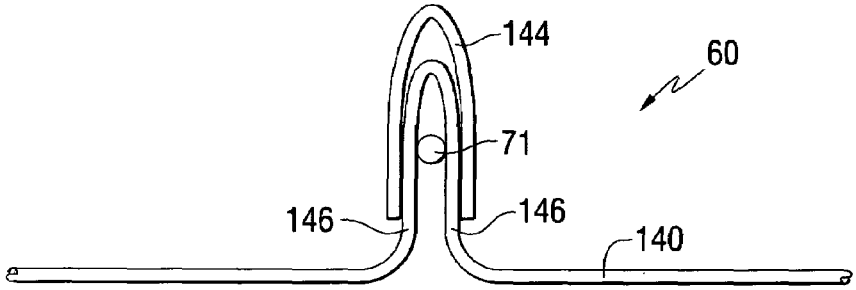
Figure 12:
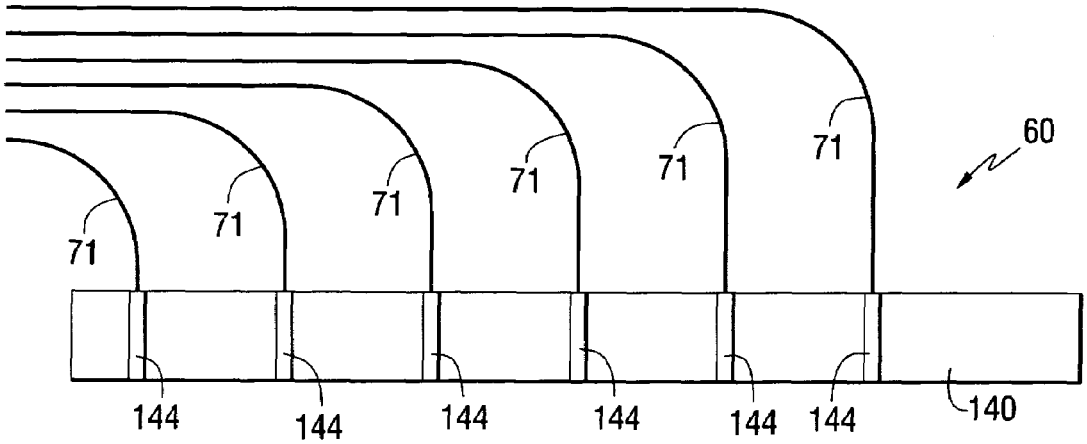

FIG. 10 shows a metal mesh 140 that can serve as the electrical conductor 60. At various locations along its length, the metal mesh 140 is crimped around a conductive wire 71, as shown in FIG. 10, and a crimpable member 144 is placed around a fold 146 of the metal mesh 140 and the wire 71. FIG. 11 shows the structure of FIG. 10 after the crimpable member 144 is crimped to capture both the wire 71 and folds 146. This physically attaches the electrical conductor 60, which is a metal mesh 140 in this embodiment, to the wire 71. The fold structure 146 shown in FIGS. 10 and 11 represents one of a plurality of such connections located along the length of the electrical conductor 60. FIG. 12 illustrates an electrical conductor 60 made of a metal mesh 140 wherein a plurality of crimpable members 144 physically and electrically attach a plurality of wires 71 to the electrical conductor 60. Although it should be understood that a large plurality of such connections is not required in all embodiments, the technique illustrated in FIGS. 10–12 can be used to assure an adequate and redundant electrical connection between the electrical conductor 60 and the source of electrical power.

Figure 13:
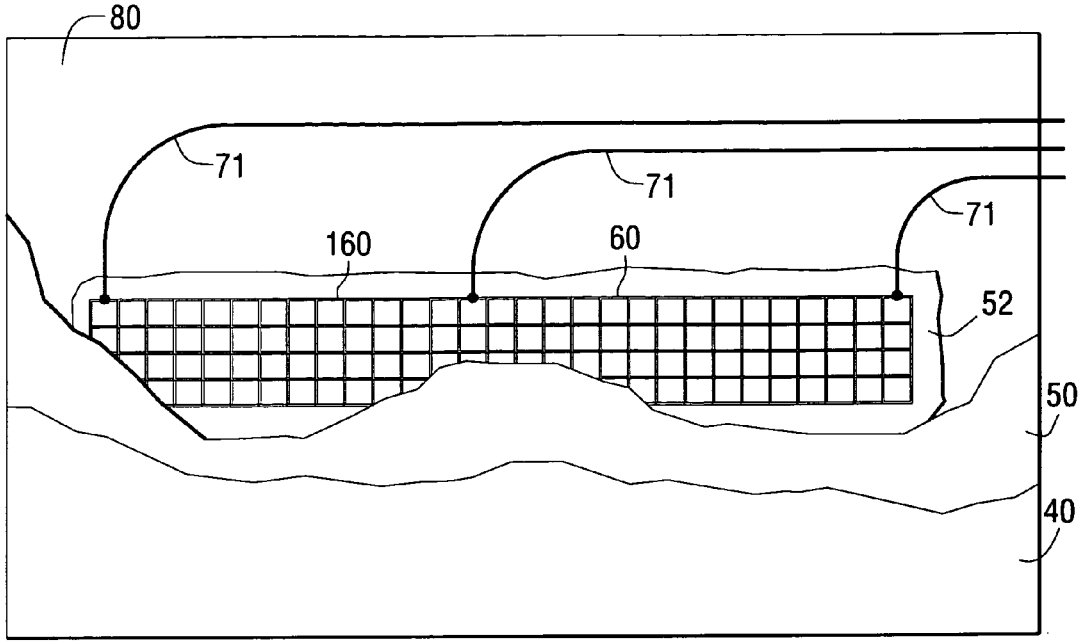
FIG. 13 shows an alternative embodiment of the electrical conductor of a preferred embodiment of the present invention.

FIG. 13 shows an alternative embodiment which incorporates a metal screen 160 as the electrical conductor 60 described above. Viewed from the outside of the multilayered structure, the sectioned view shown in FIG. 13 illustrates the outer layer 40 with the current distribution layer 50 directly beneath it. Another portion 52 of the current distribution layer 52 is shown encapsulating the metal screen 160 between it and the initial portion and within the structure of the total current distribution layer 50. A support structure 80 is shown beyond the electrical conductor 60. The wires 71 are attached in electrical communication with the metal screen 160 to provide electrical communication between it and the source of electrical power and, as a result, provide electrical communication between the source of electrical power and the current distribution layer 50.

Figure 14:
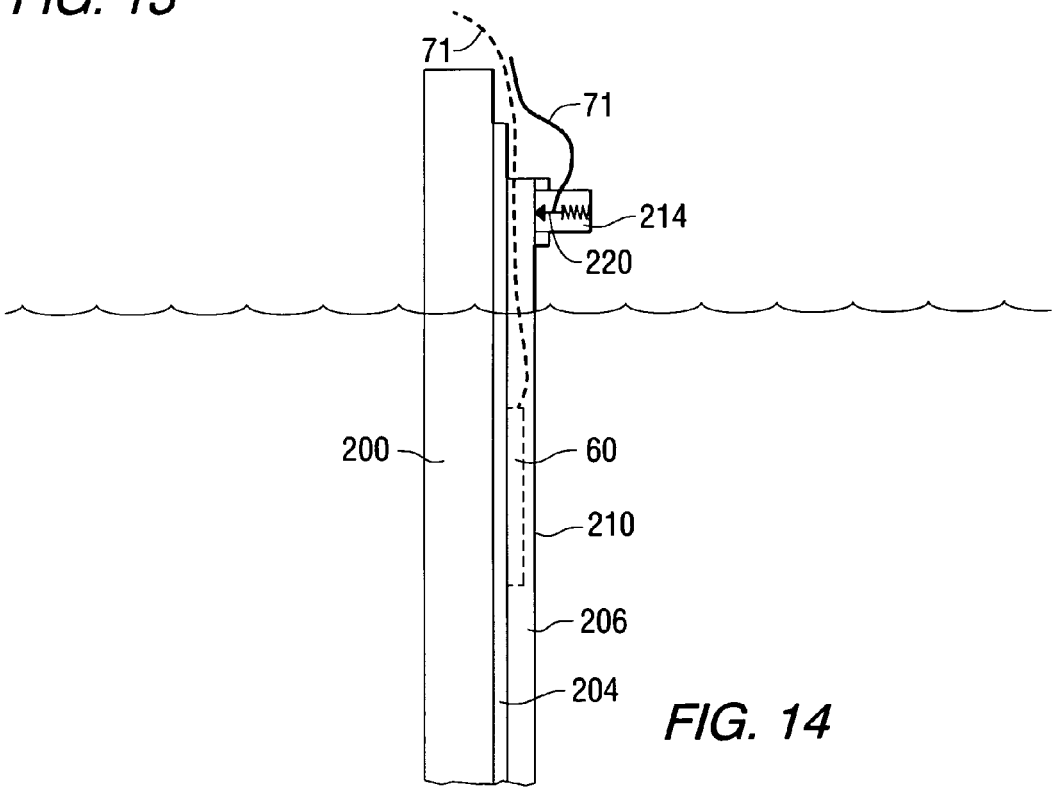
FIG. 14 shows an embodiment of the present invention used in conjunction with a metal hull of a marine vessel.

FIG. 14 shows an alternative embodiment of the present invention in which it is applied to a metal hull of a marine vessel. In the embodiment shown in FIG. 14, the support structure comprises a metal substrate 200 which can be the steel or aluminum hull of a marine vessel. In this embodiment of the present invention, an insulative layer 204 is disposed between the metal substrate 200 and the electrically conductive layer 206. The electrically conductive layer 206 can be an electrically conductive paint or gelcoat in this embodiment of the present invention. The outer surface 210 of the electrically conductive paint 206 can serve as the outer layer of this alternative embodiment. The electrical conductor in this alternative embodiment of the present invention can be a contact device 214 which makes sufficient electrical contact with the conductive paint 206. As schematically represented, a spring loaded contact member 220 is urged into electrical contact with a conductive paint 206 so that the wire 71 can be connected in electrical communication between a source of electrical power and the current distribution layer, which is the electrical paint 206 in this embodiment. Alternatively, as shown in dashed lines in FIG. 14, an electrically conductive member 60 can be provided which serves to provide electrical communication between the wire 71 and the conductive paint 206. This electrical conductor can be generally similar in function to the electrical conductors described above and can comprise a metal foil or metal screen, for example, located in electrical communication with the conductive paint 206. The conductor 60 can be more easily used when the charge distribution layer is conductive gelcoat. The insulative layer 204 can be a nonconductive gelcoat material such as the polyester resins that are well known to those skilled in the art. To apply this embodiment of the present invention to a metal hull of a marine vessel, the nonconductive gelcoat 204 is first applied to the metal hull, as illustrated in FIG. 14, and then the conductive paint 206, or conductive gelcoat, can be applied over the gelcoat insulative layer 204. The conductive paint can be a paint which comprises a polymer matrix with electrically conductive particles, such as carbon powder, suspended therein. In the embodiment shown in FIG. 14, the support structure comprises the insulative layer 204 and the metal substrate 200 which can be the metal hull of a marine vessel. The current distribution layer can be the electrically conductive paint 206 which is insulated from the metal hull 200 by the insulative gelcoat layer 204 or, alternatively, it can be a conductive gelcoat layer. The outer layer can be the outer surface 210 of the electrically conductive paint 206 and the electrical conductor can be the device identified by reference numeral 214 in FIG. 14 or, alternatively, the electrical conductor 60 that is placed in electrical communication with the conductive paint 206 or conductive gelcoat layer.

Several alternative embodiments of the present invention have been described above. Although these alternative embodiments differ in relation to the specific materials used to perform certain functions, it can be seen that the basic elements of preferred embodiments of the present invention are generally similar and perform certain basic functions. Although the alternative embodiments of the present invention have been described in relation to a marine vessel, alternate marine structures such as water intakes for power plants, permanent docks can also benefit from the invention.

With reference to FIGS. 1–14, a preferred embodiment of the present invention comprises a support structure. The support structure can, in turn, comprise the combination of fiberglass resin and woven roving described above, with wooden elements used to provide additional structural support. This structure, in several embodiments of the present invention, is intended to be electrically insulative. In some embodiments of the present invention, such as that which is described in conjunction with FIG. 14, the support structure comprises a metal substrate 200 used in conjunction with an insulative layer 204 which can be an insulative gelcoat layer.

The electrical conductor 60 can be a metal mesh material, a metal screen material, metal wire, or any other suitable electrical conductor that can be connected in electrical communication with the current distribution layer 50.

The current distribution layer 50, in a particularly preferred embodiment of the present invention, is a polymer material, such as a polyester resin, in which electrically conductive fibers or particles are suspended. The relatively inert electrically conductive fibers or particles can be carbon. Alternatively, metal screen or mesh can be alternatively used to serve the purpose of distributing the electrical current over the area of the hull or other submersible structure to be protected. If a metallic distribution layer is used, care should be taken to assure it does not directly contact water or corrosion may result.

The outer coating 40 or layer in a preferred embodiment of the present invention is a gelcoat layer which is electrically conductive. This gelcoat layer can comprise an electrically conductive powder, such as carbon, suspended in a polymer material such as a polyester resin. These four basic elements are included in preferred embodiments of the present invention.

As described above, the outer coating or outer layer 40 of the present invention can be made of a material with carbon particles suspended in a polymer matrix. The current distribution layer 50 can comprise a resin material, such as a polyester resin, with electrically conductive fibers suspended therein. The electrically conductive fibers can be carbon fibers. Alternatively, the current distribution layer 50 can comprise a material selected from the group consisting of an electrically conductive mesh material and an electrically conductive screen. The current distribution layer is generally conformable during assembly and is subsequently hardened by curing. In some applications, the polymer material is hardened through the use of a catalyst such as MEKP. The support structure 80 is electrically insulated from the current distribution layer 50 in a preferred embodiment of the present invention. However, in certain applications, an insulative layer 204 such as an insulative gelcoat can be disposed between the support structure and the current distribution layer, wherein the support structure can comprise a metal substrate such as the steel or aluminum hull of a marine vessel. In applications of this type, the current distribution layer can be a conductive paint or gelcoat and the outer coating 40 can be an outer surface of the conductive paint or gelcoat.

In various embodiments of the present invention, the electrically conductive layer, or current distribution layer (50), can be made of a material selected from the group consisting of carbon fibers suspended in a resin matrix, metal mesh, metal sheet, metal foil, an electrically conductive polymer and metal screen. The electrical conductor can be made of a material selected from the group consisting of metal screen, metal mesh, an electrically conductive polymer and metal sheet. When applied to a metal hull of a marine vessel, the current distribution layer can be electrically conductive paint. The outer layer in several preferred embodiments of the present invention, can comprise a material with electrically conductive particles, such as carbon, suspended in a gelcoat matrix, such as a polyester resin or other suitable polymer. The support structure can comprise a plurality of fiberglass laminae and a plurality of fiberglass cloth laminae, or woven roving.

Preferred embodiments of the present invention are used in conjunction with a source of electrical power, such as a battery, and a controller that can perform the functions of alternatively connecting the port and starboard current distribution layers to the source of electrical power as anodes and cathodes. This connection is typically reversed at a suitable frequency, such as every forty seconds. These techniques of sequentially switching the electrical connections are described in detail in the patents cited above.

Although several embodiments of the present invention have been described in significant detail and illustrated to show variations in structure and material choice, it should be understood that alternative embodiments are also within its scope.

We claim:

1. A multilayered submersible structure, comprising:

a support structure;

an electrical conductor connectable in electrical communication to a source of electrical power;

a current distribution layer connected in electrical communication with said electrical conductor and attached to said support structure;

an insulative layer disposed between said support structure and said current distribution layer; and an outer coating disposed in contact with said current distribution layer, said current distribution layer being a material selected from the group consisting of electrically conductive paint and a resin with suspended electrically conductive particles, said outer coating being an outer surface of said material.

2. The structure of claim 1, wherein:

said outer coating is made of a material with electrically conductive particles suspended in a polymer matrix.

3. The structure of claim 1, wherein:

said current distribution layer comprises a resin material with electrically conductive fibers suspended therein.

4. The structure of claim 3, wherein:

said electrically conductive fibers are carbon fibers.

5. The structure of claim 1, wherein:

said current distribution layer comprises a material selected from the group consisting of a carbon fiber cloth, chopped carbon fibers, a carbon fiber pressed mat, an electrically conductive mesh material and an electrically conductive screen.

6. The structure of claim 1, wherein:

said current distribution layer is conformable during assembly of said current distribution layer to said outer coating and is subsequently hardened by curing.

7. The structure of claim 1, wherein:

said support structure is electrically insulative.

8. The structure of claim 1, wherein:

said multilayered submersible structure is a portion of a hull of a marine vessel.

9. A submersible structure, comprising:

a support structure;

an electrically conductive layer attached to said support structure; and an electrical conductor connected in electrical communication with said electrically conductive layer and connectable in electrical communication with a source of electrical power, said electrically conductive layer being made of a material selected from the group consisting of carbon fibers suspended in a polymer matrix and graphite particles suspended in a polymer matrix, said support structure comprising a plurality of fiberglass laminae and a plurality of fiberglass cloth laminae.

10. The structure of claim 9, wherein:

said electrically conductive layer comprises a material with electrically conductive fibers suspended in a resin matrix which is applied as a fluid during manufacture and subsequently hardens by curing.

11. The structure of claim 9 wherein:

said submersible structure is a hull of a marine vessel.

12. A submersible structure, comprising:

a charge distribution layer;

a conductor connected in electrical communication with said charge distribution layer and connectable in electrical communication to a source of electrical power;

an outer layer disposed between said charge distribution layer and surrounding water when said submersible structure is disposed in a body of water; and a support structure attached to said charge distribution layer, said support structure comprising a plurality of alternating layers of fiberglass and fiberglass cloth.

13. The structure of claim 12, wherein:

said outer layer is made of a material selected from the group consisting of conductive paint and electrically conductive gelcoat.

14. The structure of claim 12, wherein:

said conductor is made of a material selected from the group consisting of a metal screen, a metal mesh, a metal sheet and a metal foil.

15. The structure of claim 12, wherein:

said charge distribution layer is made of a material selected from the group consisting of carbon fibers suspended in a resin matrix, a resin impregnated carbon fiber cloth, a resin impregnated carbon fiber pressed mat, a metal mesh, a metal sheet, a metal foil and a metal screen.

16. The structure of claim 12, wherein:

said charge distribution layer, said outer layer and said support structure are applied in a viscous state during manufacture and subsequently hardened.

17. The structure of claim 12, wherein:

said submersible structure is a hull of a marine vessel.

18. The structure of claim 12, wherein:

said conductor is disposed between adjacent layers of said charge distribution layer.

19. An antifouling submersible structure, comprising:

a charge distribution layer, said charge distribution layer being made of a material selected from the group consisting of electrically conductive fibers suspended in a resin matrix, a carbon fiber cloth, a carbon fiber pressed mat, a metal wire, a metal mesh, a metal sheet, a metal foil and a metal screen;

a conductor connected in electrical communication with said charge distribution layer and connectable to a source of electrical power, said conductor being made of a material selected from the group consisting of a metal screen, a carbon fiber cloth, a carbon fiber pressed mat, metal wire, a metal mesh, a metal sheet and a metal foil;

an outer layer disposed between said charge distribution layer and surrounding water when said submersible structure is disposed in a body of water, said outer layer comprising a material with carbon particles embedded in a resin matrix; and a support structure attached to said charge distribution layer, said support structure comprising a plurality of alternating layers of fiberglass and fiberglass cloth.

20. The structure of claim 19, wherein:

said charge distribution layer, said outer layer and said support structure are applied in a viscous state during manufacture and subsequently hardened by curing.

21. The structure of claim 19, wherein:

said submersible structure is a hull of a marine vessel.

22. A submersible apparatus for inhibiting marine growth on a surface, comprising:

a first structure comprising a first outer coating, a first electrically conductive layer disposed in electrical communication with said first outer coating, a first electrical conductor disposed in electrical communication with said first electrically conductive layer, and a first inner surface disposed in supporting attachment with said first electrically conductive layer;

a second structure comprising a second outer coating, a second electrically conductive layer disposed in electrical communication with said second outer coating, a second electrical conductor disposed in electrical communication with said second electrically conductive layer, and a second inner surface disposed in supporting attachment with said second electrically conductive layer, said first and second electrically conductive layers being electrically insulated from each other; and a source of electrical power which is connectable in electrical communication with said first and second electrical conductors.

23. The apparatus of claim 22, wherein:

said first and second outer coatings each comprise a material with carbon particles suspended in a resin matrix.

24. The apparatus of claim 22, wherein:

said first and second electrically conductive layers each comprise a material with carbon fibers suspended in a resin matrix.

25. The apparatus of claim 22, wherein:

said first and second inner surfaces comprise a plurality of alternating layers of fiberglass and fiberglass cloth.

26. The apparatus of claim 22, further comprising:

a metal hull of a marine vessel, said first inner surface being disposed on a port side of said metal hull in electrically insulating relation between said metal hull and said first electrically conductive layer, said second inner surface being disposed on a starboard side of said metal hull in electrically insulating relation between said metal hull and said second electrically conductive layer.

27. The apparatus of claim 26, wherein:

said first electrically conductive layer comprises a first coat of electrically conductive paint and said first outer coating comprises an outer surface of said first coat of electrically conductive paint; and said second electrically conductive layer comprises a second coat of electrically conductive paint and said second outer coating comprises an outer surface of said second coat of electrically conductive paint, said first and second coats of electrically conductive paint being electrically insulated from each other.

28. An antifouling submersible structure, comprising:

a charge distribution layer, said charge distribution layer being made of electrically conductive fibers suspended in a resin matrix;

a conductor connected in electrical communication with said charge distribution layer and connectable to a source of electrical power, said conductor being made of a material selected from the group consisting of a metal screen, a carbon fiber cloth, a carbon fiber pressed mat, metal wire, a metal mesh, a metal sheet and a metal foil;

an outer layer disposed between said charge distribution layer and surrounding water when said submersible structure is disposed in a body of water, said outer layer comprising a material with electrically conductive particles embedded in a resin matrix; and a support structure attached to said charge distribution layer, said support structure comprising fiberglass.

29. A submersible apparatus for inhibiting marine growth on a surface, comprising:

a source of electrical power;

a first structure comprising a first outer layer, a first electrically conductive layer disposed in contact with said first outer layer, a first electrical conductor disposed in electrical communication with said first electrically conductive layer, and a first inner layer disposed in supporting attachment with said first electrically conductive layer; and a second structure comprising a second outer layer, a second electrically conductive layer disposed in contact with said second outer layer, a second electrical conductor disposed in electrical communication with said second electrically conductive layer, and a second inner layer disposed in supporting attachment with said second electrically conductive layer, said first and second electrical conductors being connectable in electrical communication with said source of electrical power, said first and second electrically conductive layers being electrically insulated from each other.

30. The apparatus of claim 29, wherein:

said first and second outer layers each comprise a material with carbon particles suspended in a resin matrix.

31. The apparatus of claim 29, wherein:

said first and second electrically conductive layers each comprise a material with carbon fibers suspended in a resin matrix.

32. The apparatus of claim 29, wherein:

said first and second inner layers each comprise a plurality of alternating layers of fiberglass and fiberglass cloth.

33. The apparatus of claim 29, wherein:

said first inner layer is electrically insulative and is disposed on an external surface of a port side of a metal hull of a marine vessel in electrically insulating relation between said metal hull and said first electrically conductive layer, and said second inner layer is electrically insulative and is disposed on an external surface of a starboard side of a metal hull of a marine vessel in electrically insulating relation between said metal hull and said second electrically conductive layer.

* * * * *